US009978243B2

(12) United States Patent
Fujimoto

(10) Patent No.: US 9,978,243 B2
(45) Date of Patent: May 22, 2018

(54) WANDERING NOTIFICATION SERVER AND WANDERING NOTIFICATION SYSTEM

(71) Applicant: RAMROCK, CO., LTD., Fukuoka (JP)

(72) Inventor: Ryuji Fujimoto, Fukuoka (JP)

(73) Assignee: RAMROCK, CO., LTD., Seita, Iizuka-Shi, Fukuoka (JP)

( * ) Notice: Subject to any disclaimer, the term of this patent is extended or adjusted under 35 U.S.C. 154(b) by 0 days. days.

(21) Appl. No.: 15/551,803

(22) PCT Filed: Feb. 18, 2015

(86) PCT No.: PCT/JP2015/054485

§ 371 (c)(1),
(2) Date: Aug. 17, 2017

(87) PCT Pub. No.: WO2016/132492

PCT Pub. Date: Aug. 25, 2016

(65) Prior Publication Data

US 2018/0068546 A1 Mar. 8, 2018

(51) Int. Cl.
*G08B 23/00* (2006.01)
*G08B 21/04* (2006.01)
(Continued)

(52) U.S. Cl.
CPC ..... *G08B 21/0461* (2013.01); *G08B 21/02* (2013.01); *G08B 21/22* (2013.01)

(58) Field of Classification Search
CPC ..... G08B 21/0461; G08B 21/0415; G08B 21/0269; G08B 13/19608; G08B 21/02; G08B 27/003; G08B 25/14; G08B 25/10; G08B 25/00; G08B 21/0407; G08B 21/04; G08B 21/22; H04W 72/02; H04W 72/121;
(Continued)

(56) References Cited

U.S. PATENT DOCUMENTS 5,021,794 A * 6/1991 Lawrence ..... G01S 5/04 340/539.1
9,301,095 B2 * 3/2016 Haro ..... H04W 4/023
(Continued)

FOREIGN PATENT DOCUMENTS

JP 2004-128573 A 4/2004
JP 2005-38299 A 2/2005
(Continued)

*Primary Examiner* — Anh V La
(74) *Attorney, Agent, or Firm* — Heedong Chae; Lucem, PC

(57) ABSTRACT

A wandering notification system (1) to which the present invention is applied is provided with a management server (2), a neighborhood terminal (3), and an external terminal (4). A wandering information transmission unit (10) of the management server (2) extracts a plurality of neighborhood terminals (3) for making known information with a notification area in a certain range, set on the basis of an address of a person to be protected who starts wandering, as a reference. Further, the wandering information transmission unit (10) receives positional information of the extracted neighborhood terminals (3) and transmits personal information and wandering information of the person to be protected to the neighborhood terminal (3) that exists within the notification area.

9 Claims, 3 Drawing Sheets

(51) Int. Cl.
*G08B 21/02* (2006.01)
*G08B 21/22* (2006.01)

(58) Field of Classification Search
CPC ..... H04W 4/025; H04W 4/02; H04W 4/021; H04W 4/023; H04W 4/08; H04M 3/42348
USPC ..... 340/573.1, 573.4, 539.1, 539.14; 455/404.1, 404.2
See application file for complete search history.

(56) References Cited

U.S. PATENT DOCUMENTS

2005/0261012 A1* 11/2005 Weiser ..... H04L 12/1895 455/466
2012/0238234 A1* 9/2012 Duarte ..... G06Q 50/01 455/404.1

FOREIGN PATENT DOCUMENTS

JP 2007-226292 A 9/2007
JP 2013-143123 A 7/2013
JP 2014-67383 A 4/2014

* cited by examiner

[Fig. 1]
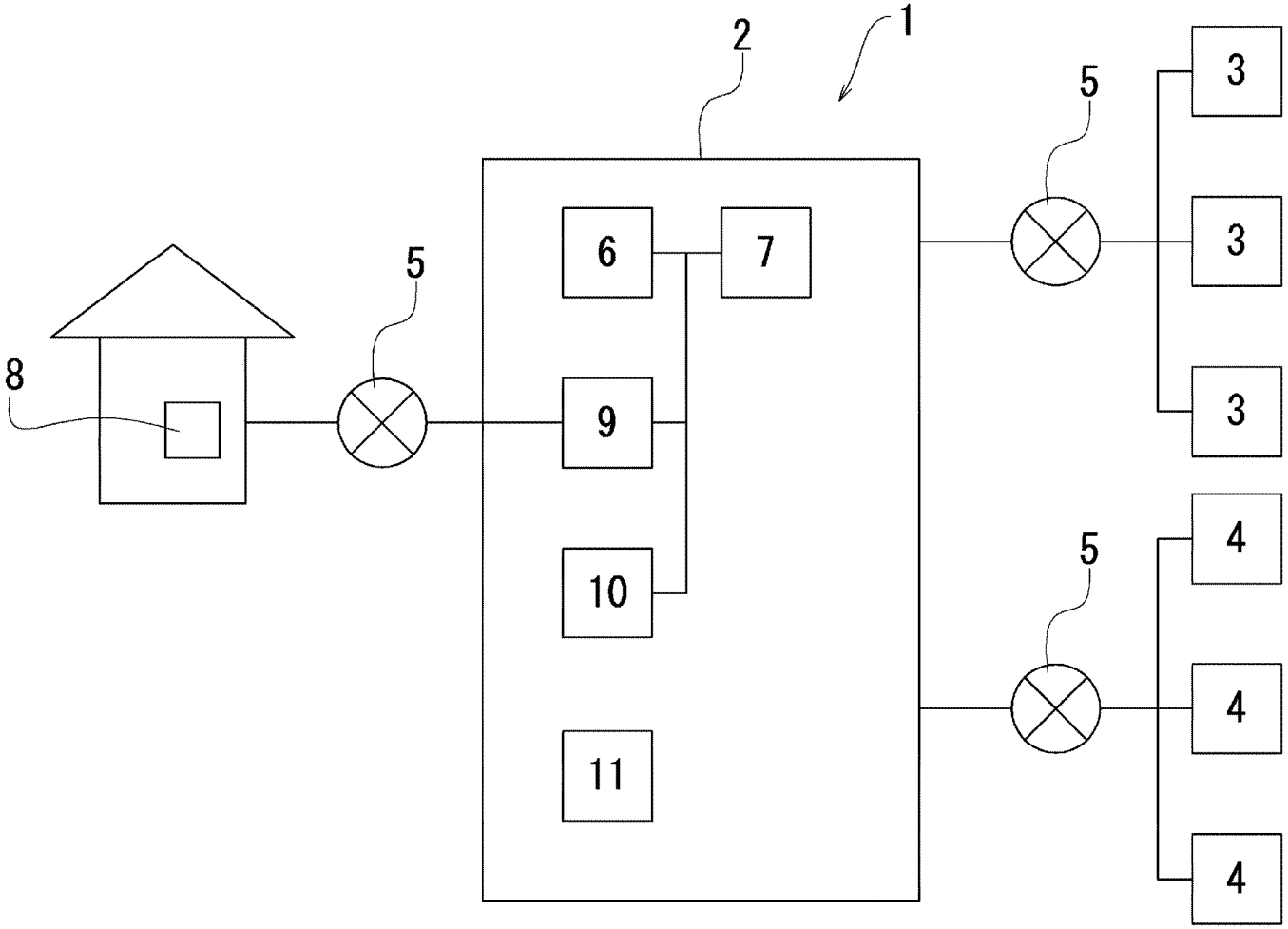

[Fig. 2]
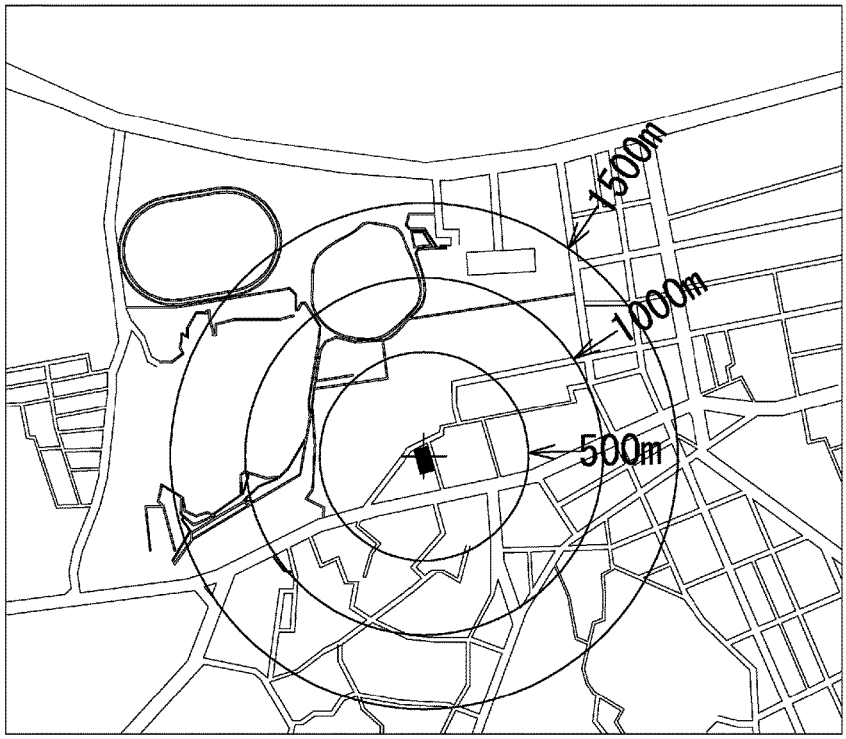

[Fig. 3]
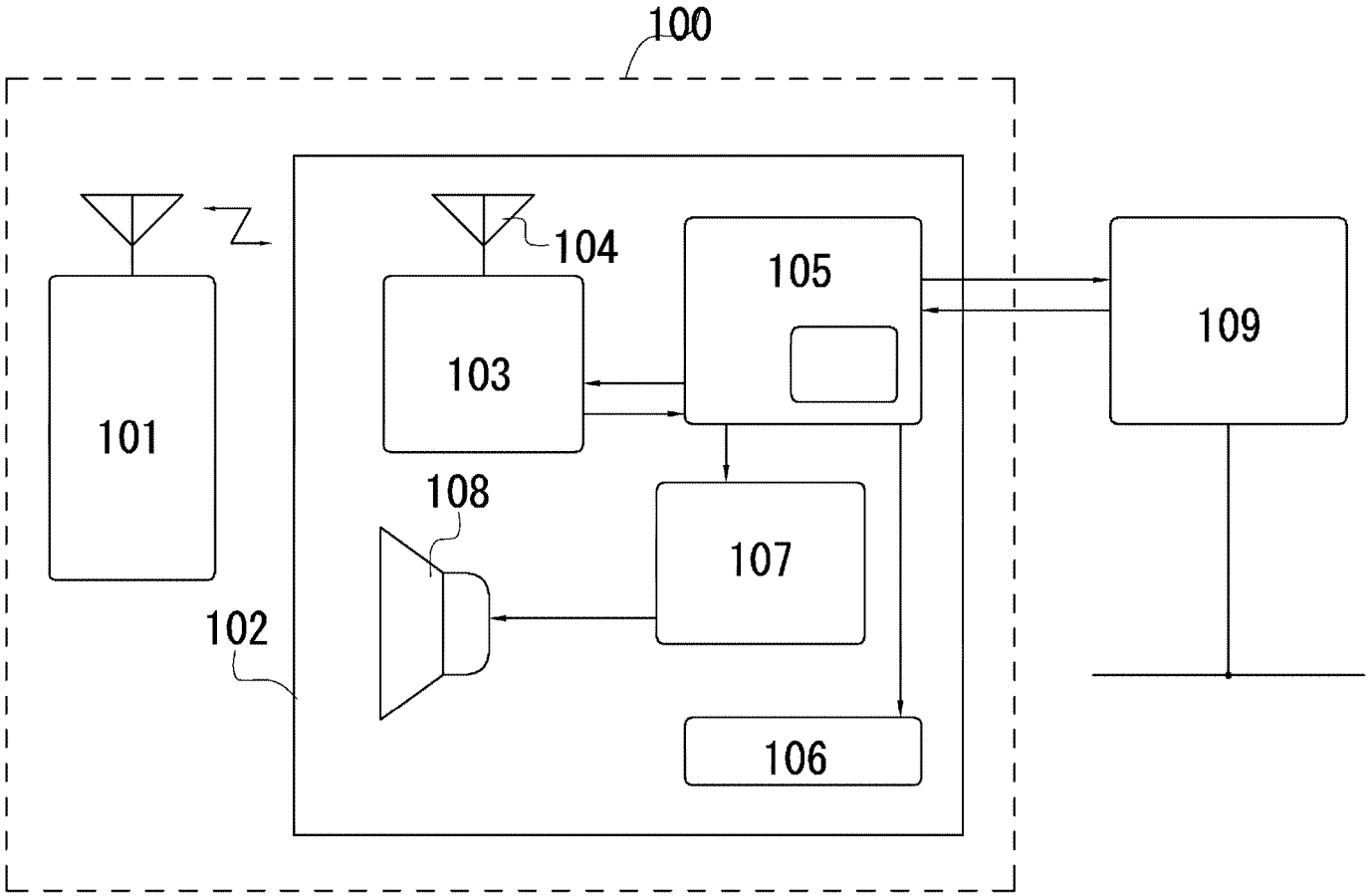

WANDERING NOTIFICATION SERVER AND WANDERING NOTIFICATION SYSTEM

TECHNICAL FIELD

The present invention relates to a wandering notification server and a wandering notification system, and more particularly, to a wandering notification server and a wandering notification system that ray quickly and accurately protect a person who performs a wandering behavior.

BACKGROUND ART

In recent years, wandering behavior of elderly people due to dementia or the like, the occurrence of accidents accompanying the wandering behavior, and an increase in the number of missing persons are becoming serious societal problems. In particular, it is difficult to adequately monitor such persons when the number of family members living with a person to be protected is small or when a person to be protected lives alone.

As a countermeasure against such wandering behavior, there is a surveillance system for acquiring positional information of a person to be protected using a portable terminal or the like. For example, a surveillance system described in Patent Document 1 has been proposed.

Patent Document 1 describes a wandering elderly protection system 100. This system, as illustrated in FIG. 3 includes a Bluetooth communication terminal 101, which is a child device carried by a person to be protected, and a Bluetooth receiver 102, which is a parent device installed in a facility or an entrance thereof.

The Bluetooth receiver 102 has a Bluetooth reception module 103 for performing Bluetooth communication with the Bluetooth communication terminal 101 and an internal antenna 104 thereof. In addition, the Bluetooth receiver 102 transmits/receives data to/from a computer 109 within the facility via a digital signal.

In addition, the Bluetooth receiver 102 also includes a control module 105 for identifying a Bluetooth address (BD address) received by the Bluetooth reception module 3, a BD address display module 106, and an audio module 107 and a speaker 108 for outputting sound that is audible to a terminal holder or notifying the surrounding persons such as a manager or a caregiver of corresponding information.

The wandering elderly protection system 100 recognizes a Bluetooth communication terminal 9 by transmission and reception of Bluetooth signals, and notifies a manager of information about the recognized Bluetooth communication terminal 9 by voice or display to prevent unauthorized departure of wandering of a person to be protected, or the occurrence of a missing child.

PRIOR ART DOCUMENT

Patent Document

Patent Document 1: Japanese Unexamined Patent Application Publication No. 2013-143123

DETAILED DESCRIPTION OF THE INVENTION

Technical Problem

However, in the system described in Patent Document 1, it is presupposed that the person to be protected carries his or her own communication terminal. For example, a person who has symptoms of dementia may remove a terminal worn on his or her own body or change clothes even if they have IC tags stitched to clothes, so that there is a possibility that detection of the person to be protected will not be satisfactorily performed.

In addition, although the system described in Patent Document 1 is effective in a specific facility and the like, when the person to be protected leaves the facility or the like, the system cannot detect the person to be protected. In addition, it may be difficult in practice to install receivers dedicated to this system over a wide area.

The present invention contrives to solve the above-mentioned problems, and an aspect of the present invention is to quickly and accurately protect a person who performs a wandering behavior.

Technical Solution

In accordance with an aspect of the present invention, there is provided a wandering notification server including: a protection target information recording unit configured to record personal information of a person to be protected and notification area information, the personal information including the address and photograph information of the person to be protected and the notification area information being an area within a predetermined range from the address; a notification destination terminal recording unit configured to record terminal information of one or more notification destination terminals capable of receiving the personal information of the person to be protected recorded in the protection target information recording unit; a wandering information reception unit configured to receive wandering information of the person to be protected from a detection apparatus; and a wandering information transmission unit configured to determine, when the wandering information reception unit receives the wandering information, whether the one or more notification destination terminals is located within the notification area, and transmit the personal information of the person to be protected to the one or more notification destination terminals within the notification area.

Here, the protection target information recording unit may specify the notification area with respect to a residence of the person to be protected by recording the personal information of the person to be protected, which is an address and photograph of the person to be protected, and notification area information in which a certain range on the basis of the address is set as a notification area. In addition, the appearance of the person to be protected may be made known. In addition, the address mentioned here includes not only the location of the residence where the person to be protected resides but also the location of a building in which the person to be protected normally stays, for example, a location of a facility or a hospital.

In addition, notification by one or more terminals of wandering information or appearance information of the person to be protected may be recorded on a server by the one or more notification destination terminals capable of receiving the personal information of the person to be protected recorded in the protection target information recording unit. In addition, the terminal information of the one or more notification destination terminals include information that can identify individual terminals.

In addition, a start of wandering of the person to be protected may be detected by the wandering information reception unit for receiving the wandering information on wandering of the person to be protected from the predetermined detection apparatus. In addition, the predetermined detection apparatus mentioned here is, for example, a monitoring device integrated with a known sensor device or a surveillance camera provided at an entrance of the residence of the person to be protected, and refers to a device capable of transmitting a signal to the server via the Internet or the like.

In addition, when the wandering information reception unit receives the wandering information, whether the one or more notification destination terminals are located within the notification area may be determined, and the appearance information and the start of the wandering of the person to be protected may be made known to the one or more notification destination terminals located within the notification area by the wandering information transmission unit for transmitting the personal information of the person to be protected to the one or more notification destination terminals located within the notification area.

In accordance with another aspect of the present invention, there is provided a wandering notification server including: a protection target information recording unit configured to record personal information of a person to be protected, the personal information including an address and photograph information of the person to be protected, and notification area information which is an area within a predetermined range from the address; a notification destination terminal recording unit configured to record terminal information of one or more neighborhood notification destination terminals, each of which is owned by a person having an address within the notification area, the one or more neighborhood notification destinations terminal being capable of receiving the personal information of the person to be protected recorded in the protection target information recording unit; a wandering information reception unit configured to receive wandering information of the person to be protected from a detection apparatus; and a wandering information transmission unit configured to determine, when the wandering information reception unit receives the wandering information, whether the one or more neighborhood notification destination terminals are located within the notification area, and transmit the personal information of the person to be protected to the one or more neighborhood notification destination terminals within the notification area.

Here, the protection target information recording unit may specify the notification area with respect to a residence of the person to be protected by recording the personal information of the person to be protected, which is an address and photograph of the person to be protected, and notification area information in which a certain range on the basis of the address is set as a notification area. In addition, the appearance of the person to be protected may be made known. In addition, the address mentioned here includes not only the location of the residence where the person to be protected resides but also the location of a building in which the person to be protected normally stays, for example, the location of a facility or a hospital.

In addition, one or more terminals of people in the vicinity of the addresses of the people to be protected may be recorded as one or more terminal for announcing the wandering information or the appearance information by the notification destination terminal recording unit for recording the terminal information of the one or more terminals owned by the people having the address within the notification area and capable of receiving the personal information of the person to be protected, each of which is recorded in the protection target information recording unit, which serves as the one or more neighborhood notification destination terminals. In addition, terminal information of the one or more neighborhood notification destination terminals include information that can identify individual terminals.

In addition, a start of wandering of the person to be protected may be detected by the wandering information reception unit for receiving the wandering information on wandering of the person to be protected from the predetermined detection apparatus. In addition, the predetermined detection apparatus mentioned here is, for example, a monitoring device integrated with a known sensor device or a surveillance camera provided at an entrance of the residence of the person to be protected, and refers to a device capable of transmitting a signal to the server via the Internet or the like.

In addition, when the wandering information reception unit receives the wandering information, whether the one or more neighborhood notification destination terminals are located within the notification area may be determined, and the appearance information and the start of the wandering of the person to be protected may be made known to the one or more neighborhood notification destination terminals located within the notification area by the, wandering information transmission unit for transmitting the personal information or the person to be protected to the one or more neighborhood notification destination terminals located within the notification area.

In addition, when the notification destination terminal recording unit records terminal information of one or more external notification destination terminals, each of which is owned by a person who does not have an address within the notification area and is capable of receiving the personal information of the person to be protected recorded in the protection target information recording unit, the person to be protected who performs a wandering behavior may be more easily protected by enlarging the range of the one or more notification destination terminals.

In addition, when the wandering information reception unit receives the wandering information, the wandering information transmission unit may determine whether the one or more neighborhood notification destination terminals are located within the notification area, and may transmit the personal information of the person to be protected to the one or more external notification destination terminals located within the notification area when the one or more neighborhood notification destination terminals are not located within the notification area, so that it is possible to more easily protect the person to be protected who performs further wandering behavior.

In addition, the protection target information recording unit may more easily protect the person to be protected who performs the further wandering behavior by enlarging the range of the notification area according to a lapse of time since the wandering information reception unit received the wandering information. That is, the notification area may correspond to the range of wandering, which is enlarged according to the lapse of time.

In the case in which the notification destination terminal recording unit records information about a plurality of neighborhood notification destination terminals, and the wandering information transmission unit detects the number of neighborhood notification destination terminals located within the notification area when the wandering information reception unit receives the wandering information and transmits the personal information of the person to be protected to the one or more external notification destination terminals located within the notification area when the number of neighborhood notification destination terminals is lower than a predetermined number, information about the number of neighborhood notification destination terminals located within the notification area may be used as a notification condition to the one or more external notification destination terminals, so that effective notification may be made possible. In addition, when the number of neighborhood notification destination terminals exceeds the predetermined number, notification may be made to the plurality of neighborhood notification destination terminals located within the original notification area as it is.

In addition, when the wandering information transmission unit transmits the personal information of the person to be protected to the one or more external notification destination terminals located within the notification area together with positional information of the one or more external notification destination terminals, owners of the one or more external notification destination terminal may know their locations, and it may be easy to perform information transmission at the time of search or discovery of the person to be protected. That is, for example, even when the owner of the one or more external notification destination terminals are not familiar with a geographical area in the notification area, the owners may know their locations and grasp a positional relationship with the address of the person to be protected.

In addition, when the wandering notification server includes a discovery information transmission/reception unit for transmitting discovery information to the one or more neighborhood notification destination terminals and the one or more external notification terminals while receiving the discovery information of the person to be protected, the discovery information of the person to be protected may be made known to each terminal.

In accordance with still another aspect of the present invention, there is provided a wandering notification system including: a neighborhood notification destination terminal configured to be owned by a person having an address in the vicinity of the address of a person to be protected; and a wandering notification server configured to include a protection target information recording unit for recording personal information of a person to be protected, which is an address and photograph of the person to be protected, and notification area information in which a certain range on the basis of the address of the person to be protected is set as notification area, a notification destination terminal recording unit for recording terminal information of the neighborhood notification destination terminal, a wandering information reception unit for receiving wandering information on wandering of the person to be protected from a predetermined detection apparatus, and a wandering information transmission unit for determining whether the neighborhood notification destination terminal is located within the notification area when the wandering information reception unit receives the wandering information and transmitting the personal information of the person to be protected to the neighborhood notification destination terminal located within the notification area.

Here, the protection target information recording unit may specify the notification area with respect to a residence of the person to be protected by recording the personal information of the person to be protected, which is an address and photograph of the person to be protected, and notification area information in which a certain range on the basis of the address is set as a notification area. In addition, an appearance of the person to be protected may be made known. In addition, the address mentioned here includes not only a location of the residence where the person to be protected resides but also the location of a building in which the person to be protected normally stays, for example, the location of a facility or a hospital.

In addition, the terminal of the person in the vicinity of the address of the person to be protected may be recorded on a server as a terminal for making known wandering information or appearance information by the neighborhood notification destination terminal owned by the person having the address in the vicinity of the address of the person to be protected and the notification destination terminal recording unit for recording terminal information of the neighborhood notification destination terminal. In addition, the terminal information of the neighborhood notification destination terminal includes information that can identify individual terminals.

In addition, a start of wandering of the person to be protected may be detected by the wandering information reception unit for receiving the wandering information on wandering of the person to be protected from the predetermined detection apparatus. In addition, the predetermined detection apparatus mentioned here is, for example, a monitoring device integrated with a known sensor device or a surveillance camera provided at an entrance of the residence of the person to be protected, and refers to a device capable of transmitting a signal to the server via the Internet or the like.

In addition, the appearance information and the start of the wandering of the person to be protected may be made known to the neighborhood notification destination terminal located within the notification area by the wandering information transmission unit that determines whether the neighborhood notification destination terminal is located within the notification area when the wandering information reception unit receives the wandering information and transmits the personal information of the person to be protected to the neighborhood notification destination terminal located within the notification area.

In accordance with yet another aspect of the present invention, there is provided a wandering notification system including: a notification destination terminal configured to personal information of a person to be protected; and a wandering notification server configured to include a protection target information recording unit for recording the personal information of the person to be protected, which is an address and photograph of the person to be protected, and notification area information in which a certain range on the basis of the address of the person to be protected is set as a notification area, a notification destination terminal recording unit for recording terminal information of the notification destination terminal, a wandering information reception unit for receiving wandering information on wandering of the person to be protected from a predetermined detection apparatus, and a wandering information transmission unit for determining whether the notification destination terminal is located within the notification area when the wandering information reception unit receives the wandering information and transmitting the personal information of the person to be protected to the notification destination terminal located within the notification area.

Here, the protection target information recording unit may specify the notification area with respect to a residence of the person to be protected by recording the personal information of the person to be protected, which is an address and photograph of the person to be protected, and notification area information in which a certain range on the basis of the address is set as a notification area. In addition, the appearance of the person to be protected may be made known. In addition, the address mentioned here includes not only the location of the residence where the person to be protected resides but also the location of a building in which the person to be protected normally stays, for example, the location of a facility or a hospital.

In addition, information about a terminal for making known the wandering information or appearance information of the person to be protected may be recorded on a server by the notification destination terminal recording unit for recording the terminal information of the notification destination terminal capable of receiving the personal information of the person to be protected recorded in the protection target information recording unit. In addition, the terminal information of the notification destination terminal includes information that can identify individual terminals.

Advantageous Effects

A wandering notification server according to the present invention as described above may quickly and accurately protect a person who performs a wandering behavior.

A wandering notification system according to the present invention as described above may quickly and accurately protect a person who performs a wandering behavior. Additionally, the system of the present invention does not require the person to be protected to carry a communication terminal as in the prior art.

BRIEF DESCRIPTION OF THE DRAWINGS

FIG. 1 is a schematic diagram showing an example of the configuration of a wandering notification system to which the present invention is applied;

FIG. 2 is a schematic diagram showing an enlargement of the range of a notification area; and FIG. 3 is e schematic diagram showing a conventional wandering elderly protection system.

MODE FOR CARRYING OUT THE INVENTION

Hereinafter, embodiments of the present invention will be described with reference to the drawings so that the present invention can be understood.

FIG. 1 is a schematic diagram showing an example of the configuration of a wandering notification system to which the present invention is applied. In addition, the configuration of the present invention is not limited to the following content, but can be appropriately changed.

As shown in FIG. 1, a wandering notification system 1 to which the present invention is applied includes a management server 2, one or more neighborhood terminals 3, and one or more external terminals 4. The management server 2 and the one or more neighborhood terminals 3, and the management server 2 and the one or more external terminals 4 are connected to each other via the Internet 5, respectively. The Internet 5 may be the internet or another computer network system.

The one or more neighborhood terminals 3 are one or more terminals of people who have addresses in the range of a notification area on the basis of an address of a person to be protected registered in the management server 2, and may transmit and receive information to and from the management server 2.

The one or more external terminals 4 are one or more terminals of people who do not have addresses in a range of the notification area on the basis of an address of the person to be protected registered in the management server 2, and may transmit and receive information to and from the management server 2.

The one or more neighborhood terminal 3 and the one or more external terminal 4 may use, for example, portable terminals, smart phones, or tablets. In addition, each of terminals is a terminal that can use an existing positioning function. The positioning function is, for example, a GPS (Global Positioning System) function or a wireless LAN Positional information function, and may transmit positional information of the terminal to the management server 2.

The management server 2 has a protection target information database 6. In the protection target information database 6, personal information including an address and photograph of an elderly person or a person with symptoms of dementia as a person to be protected is recorded. In addition, the address mentioned here includes not only the location of a residence where a person to be protected resides but also the location of a building in which a person to be protected normally stays, for example, the location of a facility or a hospital.

In addition, the personal information of the person to be protected may include personal information that specifies the person to be protected, such as the name, age, appearance characteristics, and the like. In addition, as the photograph, a still image based on image information obtained by a detection apparatus, described later, in addition to a face image of a person himself/herself may be used. Using the still image based on the image information obtained by the detection apparatus, it is possible to make known information on the clothes and appearance of the person to be protected the person to be protected starts wandering.

In addition, as the personal information of the person to be protected, history information about the wandering behavior of the person to be protected may be recorded. For example, history information such as the place where the wandering behavior has been confirmed in the past or the time block in which the wandering behavior is shown is recorded. By recording the history information, the recorded history information becomes available as reference information when notifying each terminal of the wandering behavior.

In the protection target information database 6, a certain range on the basis of the address of the person to be protected may be recorded as a notification area for making known wandering information. Setting of the range of the notification area may be performed by an arbitrary numerical value or condition, but setting of a range of, for example, a radius of 500 m from the address may be recorded.

In addition, in the protection target information database 6, an enlarged notification area, in which the range of the notification area is gradually widened with the lapse of time, may be recorded. For example, when the above-described radius of 500 m is an initial range of the notification area, a radios of 1 km may be recorded as the range of the enlarged notification area after the lapse of 15 minutes from the start of the wandering, and a radius of 1.5 km may be recorded as the range of the enlarged notification area after the lapse of 30 minutes from the start of the wandering.

In addition, when there is a dangerous place near the address of the person to be protected, the dangerous place may be set to be included in the range of the notification area in advance, or to be noticeable as a place with high risk for notification. For example, a place in which the person to be protected is likely to be affected by an accident, such as a railway crossing, a station, a body of water, or a river, is included in the notification area.

Here, the enlarged notification area in which the range of the notification area is gradually widened with the lapse of time is not necessarily recorded in the protection target information database 6. However, in terms of expanding the notification area with the lapse of time and increasing the efficiency of discovery of the person to be protected, it is preferable that the enlarged notification area in which the range of the notification area is gradually widened with the lapse of time be recorded in the protection target information database 6.

In addition, the management server 2 also has a notification destination terminal information database 7 for recording terminal information of the one or more neighborhood terminals 3 and the one or more external terminal 4. The terminal information includes information of individual terminal codes capable of recognizing each of terminals and information on the addresses of the terminal owners.

In addition, in the notification destination terminal information database 7, the personal information of all the persons to be protected recorded in the protection target information database 6 and the terminal information of the one or more neighborhood terminals 3 and the one or more external terminals 4 may be associated with each other to be recorded. As a result, one or more owners of one or more notification destination terminal may request protection for the person to be protected at the time of wandering of the person to be protected, even when the owner of the notification destination terminal is not acquainted with the person to be protected.

On the other hand, in the notification destination terminal information database 7, it is also possible to associate personal information of a specific person to be protected with terminal information of a specific neighborhood terminal 3 and a specific external terminal 4.

The management server 2 has a wandering information reception unit 9 that receives wandering information indicating the start of wandering transmitted from a detection apparatus 8 installed at the entrance of the house, or the like, of the person to be protected. The detection apparatus 8 may use an existing monitoring device.

As the detection apparatus 8, there can be used, for example, a sensor mechanism for detecting the entry and exit of a person, and a surveillance mechanism for capturing an image of a person to be protected when the person to be protected goes outdoors using a surveillance camera installed at the entrance. Further, when it is determined that wandering has started, the detection apparatus 8 has a function of transmitting wandering information to the wandering information reception unit 9 via the Internet 5.

The management server 2 includes a wandering information transmission unit 10 that transmits personal information and wandering information of the person to be protected to the one or more neighborhood terminals 3 or the one or more external terminals 4 when the wandering information reception unit 9 receives the wandering info ration from the detection apparatus 8.

The wandering information transmission unit 10 extracts a plurality of neighborhood terminals for making known information based on the notification area in a certain range set on the basis of the address of the person to be protected who starts wandering. Further, the wandering information transmission unit 10 receives positional information of the extracted neighborhood terminals 3, and transmits the personal information and wandering information of the person to be protected to the neighborhood terminals 3 that exist within the notification area.

In addition, the wandering information transmission unit 10 receives positional information of the one or more external terminals 4 when the wandering information reception unit 9 receives the wandering information from the detection apparatus 8, and specifies the one or more external terminals 4 that exist within the notification area. Next, the wandering information transmission unit 10 transmits the personal information and wandering information of the person to be protected to the one or more external terminals 4 that exists within the notification area when the number of neighborhood terminals 3 located within the notification area is lower than a predetermined number.

Here, the notification of the wandering information to the one or more external terminals 4 may be also set under conditions other than the number of the neighborhood terminals 3 located within the notification area. For example, a specific neighborhood terminal 3 may be set for a specific person to be protected. The notification may be made to the one or more external terminals 4 when the specific neighborhood terminal 3 is not located within the notification area. In addition, it is also possible to simultaneously notify the one or more neighborhood terminals 3 and the one or more external terminals 4 existing within the notification area of the wandering information.

Here, when the number of the neighborhood terminals 3 located within the notification area is lower than the predetermined number, the personal information and wandering information of the person to be protected is not necessarily transmitted to the one or more external terminals 4 existing within the notification area. For example, the wandering information may be made known to the one or more external terminals 4 located within the notification area in the state in which a plurality of neighborhood terminals 3 is recorded, and some of the neighborhood terminals 3 are located within the notification area. In addition, the wandering information may be made known to the one or more external terminals 4 regardless of whether the neighborhood terminal 3 exists within the notification area. In addition, as described above, whether a specific neighborhood terminal 3 exists within the notification area May be used as a trigger for the notification of the wandering information.

In addition, the wandering information transmission unit 10 may also transmit the positional information received from the one or more external terminals 4 when transmitting the personal information and wandering information of the person to by protected to the one or more external terminals 4. The positional information is, for example, information that can display map information including the notification area and the positional information of the external terminal 4 together.

The management server 2 has a discovery information transmission/reception unit 11 that receives discovery information indicating that the person to be protected has been found from the one or more neighborhood terminals 3 and the one or more external terminals 4. When the discovery information is received from each terminal, the information indicating that the person to be protected has been found may be transmitted to the one or more neighborhood terminals 3 and the one or more external terminals 4 to which other notifications have been made, via the discovery information transmission/reception unit 11.

Hereinafter, the flow of the notification in the wandering notification system 1 having the above-described configuration will be described. The flow of the notification shown below is merely an example, and can be appropriately changed.

First, a person to be protected goes out of his or her house and starts wandering. The detection apparatus 8 installed at the entrance of the house detects the wandering of the person to be protected, and transmits wandering information, including information about the start of the wandering of the person to be protected and a still image at the start of the wandering, to the wandering information reception unit 9 of the management server 2.

When the wandering information reception unit 9 of the management server 2 receives the wandering information, the wandering information transmission unit 10 extracts a neighborhood terminal 3 for notifying information based on a notification area set on the basis of an address of the person to be protected. Next, the wandering information transmission unit 10 receives positional information of the extracted neighborhood terminal 3 and transmits personal information and wandering information of the person to be protected to the one or more neighborhood terminals 3 existing within the notification area.

In addition, the wandering information transmission unit 10 also receives positional information of the external terminal 4 and specifies the external terminal 4 existing within the notification area. Next, the wandering information transmission unit 10 transmits the personal information and wandering information of the person to be protected to the external terminal 4 that exists within the notification area, when the number of the neighborhood terminals 3 located within the notification area is lower than a predetermined number.

The one or more neighborhood terminals 3 and the one or more external terminals 4 to which notification of the wandering information has been made receive an address of the person to be protected who performs a wandering behavior and image information through which the person to be protected is identified. In addition, the one or more external terminals 4 receive a location of the one or more external terminals 4 and map information around the location. Here, the nap information around the location is not necessarily received, but it is effective in that a holder of the external terminal 4 who does not know the corresponding topography in detail can easily understand his/her location and the surrounding geographical area.

An owner of each of the one or more neighborhood terminals 3 and the one or more external terminals 4 may confirm whether there is a person to be protected in the vicinity of the owners based on the received information.

In addition, when a predetermined time has elapsed from the start of the wandering, the range of the notification area is expanded, whether the one or more neighborhood terminals 3 and the one or more external terminals 4 exist in the notification area is confirmed, and the notification of the wandering information is made. As shown in FIG. 2, at the time of the start of the wandering, a radius of 500 m around the address of the person to be protected may be set as an initial range of the notification area.

In addition, a radius of 1 km may become the range of an enlarged notification area after the lapse of 15 minutes from the start of the wandering, and a radius of 1.5 km may become the range of the enlarged notification area after the lapse of 30 minutes from the start of the wandering. Whether the one or more neighborhood terminals 3 and the one or more external terminals 4 exist within the notification area is confirmed at each time point, and the wandering information may be made known to the one or more neighborhood terminals 3 or the one or more external terminals 4 which is located within the notification area according to setting conditions.

When one or more owners of the one or more neighborhood terminals 3 or the one or more external terminals 4 find the person to be protected, the one or more owners access the management server 2 via the Internet 5 and transmit information indicating that the person to be protected has been found. When the discovery information transmission/reception unit 11 receives information from a discoverer and the identity of the person to be protected is confirmed, the management server 2 transmits again the information indicating that the person to be protected has been found to the one or more neighborhood terminals 3 or the one or more external terminals 4 that has received the wandering information.

As described above, in the wandering notification system to which the present invention is applied, the efficiency of discovery may be improved by performing rapid notification when a person to be protected starts wandering. That is, by transmitting wandering information to owners of terminals existing within a notification area, it is possible to promote the search of the surroundings to protect the person to be protected.

As described above, the wandering notification server according to the present invention may quickly and accurately protect a person who performs a wandering behavior.

Further, the wandering notification system according to the present invention may quickly and accurately protect a person who perform a wandering behavior.

DESCRIPTION OF THE REFERENCE NUMERALS

1: Wandering notification system
2: Management server
3: Neighborhood terminal
4: External terminal
5: Internet
6: Protection target information database
7: Notification destination terminal database
8: Detection apparatus
9: Wandering information reception unit
10: Wandering information transmission unit
11: Discovery information transmission/reception unit

The invention claimed is:

1. A wandering notification server comprising:

a protection target information recording unit adapted to record personal information of a target person to be protected and notification area information, the personal information including an address and photograph information of the target person and the notification area information including information for a notification area within a predetermined range from the address;

a notification destination terminal recording unit configured to record terminal information of one or more neighborhood terminals, each of which is owned by a neighborhood person having a neighborhood address within the notification area, the one or more neighborhood terminals being capable of receiving the personal information of the target person recorded in the protection target information recording unit, and record terminal information of one or more external terminals, each of which is owned by a external person who does not have an external address within the notification area, the one or more external terminals being capable of receiving the personal information of the target person recorded in the protection target information recording unit;

a wandering information reception unit configured to receive wandering information of the target person from a detection apparatus; and a wandering information transmission unit configured to determine, when the wandering information reception unit receives the wandering information, whether the one or more neighborhood terminals are located within the notification area, transmit the personal information of the target person to the one or more neighborhood terminals when information about presence and absence of the one or more neighborhood terminals within the notification area satisfies a predetermined condition, and transmit personal information of the target person to the one or more external terminals located within the notification area when the information about presence and absence of the one or more neighborhood terminals within the notification area does not satisfy the predetermined condition.

2. The wandering notification server as claimed in claim 1, wherein the notification destination terminal recording unit is adapted to record terminal information of the one or more neighborhood terminals, the predetermined condition is whether predetermined minimum number of the neighborhood terminals located within the notification area are present, and the wandering information transmission unit is configured to detect, when the wandering information reception unit receives the wandering information, the number of the neighborhood terminals located within the notification area and transmit, when the number of the neighborhood terminals located within the notification area is lower than the predetermined number, the personal information of the target person to the one or more external terminals located within, the notification area.

3. The wandering notification server as claimed in claim 1, wherein the notification destination terminal recording unit is configured to record at least one of the neighborhood terminals as a specific neighborhood terminal, and the predetermined condition is whether the specific neighborhood terminal is located within the notification area.

4. The wandering notification server as claimed in claim 1, wherein the personal information of the target person includes wandering history information which is information about prior wandering performed by the target person, and the wandering history information includes information about a place in which at least wandering is confirmed or information about a time frame in which wandering is performed.

5. The wandering notification server as claimed in claim 1, wherein the notification area information includes hazardous area information which is information about an area in which the target person is likely to be involved in an accident.

6. The wandering notification server as claimed in claim 1, wherein the protection target information recording unit is configured to enlarge a range of the notification area according to a lapse of time after the wandering information reception unit receives the wandering information.

7. The wandering notification server as claimed in claim 1, wherein the wandering information transmission unit is configured to transmit the personal information of the target person to the one or more external terminals located within the notification area, together with positional information of the one or more external terminals.

8. The wandering notification server as claimed in claim 1, further comprising:

a discovery, information transmission/reception unit adapted to receive discovery information of the target person, and transmit the received discovery information to the one or more neighborhood terminals and the one or more external terminals.

9. A wandering notification system comprising:

one or more neighborhood terminals, each of the one or more neighborhood terminals being owned by a neighborhood person having an address in a predetermined region having an address of a target person to be protected;

one or more external terminals, each of the one or more external terminals being owned by an external person who does not have an address in a predetermined region having an address of the target person; and a wandering notification server including a protection target information recording unit configured to record personal information of the target person and notification area information, the personal information including an address and photograph information of the target person and the notification area information being an area within a predetermined range from the address, a notification destination terminal recording unit configured to record terminal information of the one or more neighborhood terminals and terminal information of the one or more external terminals, a wandering information reception unit configured to receive wandering information of the person to be protected from a detection apparatus, and a wandering information transmission unit configured to determine, when the wandering information reception unit receives the wandering information, whether the one or more neighborhood terminals are located within the notification area, transmit the personal information of the person to be protected to the one or more neighborhood terminals when information about presence and absence of the one or more neighborhood terminals within the notification area satisfies a predetermined condition, and transmit the personal information of the person to be protected to the one or more external terminals located within the notification area when the information about presence and absence of the neighborhood terminal within the notification area does not satisfy the predetermined condition.

* * * * *